United States Patent [19]

LeBlanc et al.

[11] 3,963,437

[45] June 15, 1976

[54] FLAME RETARDANT PROCESS FOR CELLULOSIC MATERIAL INCLUDING CYANAMIDE, PHOSPHONIC ACID, ANTIMONY OXIDE AND POLYMERIC HALOGEN-CONTAINING MATERIAL

[75] Inventors: Destin A. LeBlanc; Robert Bruce LeBlanc, both of Wickford, R.I.

[73] Assignee: Cotton Incorporated, New York, N.Y.

[22] Filed: Apr. 15, 1974

[21] Appl. No.: 461,106

[52] U.S. Cl. ..... 8/192; 8/115.6; 8/116 P; 260/45.75 B

[51] Int. Cl.[2] ..... D06M 13/30; D06M 13/44

[58] Field of Search ..... 8/115.6 X, 116 P, 192

[56] References Cited

UNITED STATES PATENTS

| | | | |
|---|---|---|---|
| 2,519,388 | 8/1950 | Loukomsky et al. | 428/276 |
| 3,219,478 | 11/1965 | Wagner | 260/853 |
| 3,567,359 | 3/1971 | Blackburn et al. | 8/116.2 |
| 3,827,907 | 8/1974 | LeBlanc | 117/62.1 |

FOREIGN PATENTS OR APPLICATIONS

| | | |
|---|---|---|
| 1,317,468 | 5/1973 | United Kingdom |

*Primary Examiner*—John C. Bleutge
*Assistant Examiner*—Arthur H. Koeckert
*Attorney, Agent, or Firm*—Burns, Doane, Swecker & Mathis

[57] ABSTRACT

A process for imparting durable flame-retardant properties to cellulosic fiber-containing materials without detrimentally affecting other properties (e.g., shrinkage, hand, etc.) of the material is disclosed. The material is contacted with cyanamide; at least one phosphonic acid represented by the structural formula:

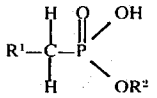

wherein $R^1$ represents a monovalent radical selected from the group consisting of hydrogen, halogen, hydroxy, lower alkyl and lower alkoxy, and wherein $R^2$ represents a monovalent radical selected from the group consisting of hydrogen and lower alkyl; antimony oxide; and a polymeric halogen-containing material.

8 Claims, No Drawings

FLAME RETARDANT PROCESS FOR CELLULOSIC MATERIAL INCLUDING CYANAMIDE, PHOSPHONIC ACID, ANTIMONY OXIDE AND POLYMERIC HALOGEN-CONTAINING MATERIAL

BACKGROUND OF THE INVENTION

Cellulosic fiber-containing textile materials such as cotton cloth have been employed since ancient times. However, the combustibility of these textile materials has inhibited their wider use in certain instances. A great number of flame retardants have been proposed for use with cellulosic textile materials, but these flame retardants suffer from one or more disadvantages.

A major disadvantage of many prior flame retardants is their lack of wash fastness or durability, by which is meant that while they initially render the cellulosic textile material flame retardant, such flame retardancy disappears after one or more household launderings, especially in hard water. This phenomenon is described by O'Brien in "Cyanamide-Based Durable Flame-Retardant Finish for Cotton," Textile Research Journal, March 1968, pp. 256–266. This article describes the treatment of cellulosic textile materials with flame retardants of cyanamide and phosphoric acid. However, the flame retardants disclosed therein by O'Brien are not resistant to hard water washing. similarly, East German Pat. Nos. 15,357 and 18,253, and Schiffner et al in *Faserforsch u. Texiltech.*, 14, (9), 375–86 (1963) describe specific attempts to impart flame resistance to textile material with certain flame retardants, including combinations of urea or dicyandiamide with chloromethyl phosphonic acid, or urea with hydroxymethyl phosphonic acid, which combinations may also not be resistant or durable to repeated cycles of hard water washings, or which may unduly degrade the physical strengths of fabrics.

Other disadvantages include the relatively large quantities (high add-on) which may be necessary in order to impart flame retardance, and the undesirable alternation of other properties of the cellulosic textile material such as hand, color, and susceptibility to dying.

Also, many flame retardants are incompatible with commonly employed creaseproofing agents; in the past this limitation has discouraged use of flame retardants in conjunction with a creaseproofing operation so as to yield a textile material which is both flame retardant and wrinkle resistant. In addition, some flame retardants can cause undue shrinkage of the treated fabrics.

An efficacious process for rendering cellulosic fiber-containing textile materials flame retardant is shown in British Pat. No. 1,317,468. As disclosed therein, the textile material is contacted with certain alkyl or haloalkyl phosphonic acids (or their half esters) in conjunction with an amino compound such as cyanamide, methylolated cyanamide, methylolated melamines, methylolated cyanoguanidine or mixtures thereof, to deposit thereon a flameproofing amount of the phosphonic acid with the amino compound.

The search has continued for commercially acceptable processes for imparting flame retardancy to cellulosic fiber-containing textile materials.

SUMMARY OF THE INVENTION

Accordingly, a primary object of the present invention is to render fiber-containing material flame retardant while preventing or substantially alleviating one or more of the above-discussed disadvantages of prior processes.

Another object is to provide an improved process for imparting flame retardancy to cellulosic fiber-containing textile materials which flame retardancy is durable and resistant to multiple household launderings.

Another object is to provide an improved cellulosic fiber flame retarding process requiring only a relatively small add-on or amount of flame retardants.

A still further object is to provide an improved process for rendering cellulosic fiber-containing textile material flame retardant which does not adversely affect the other properties of the material.

Another object is to provide an improved process for rendering cellulosic fiber-containing textile materials flame retardant without significantly causing shrinking or adversely affecting the hand of the material.

Another object of the present invention is to provide a cellulosic flame retarding process having improved efficiencies of reaction between the flame retardants and the cellulosic material.

Yet another object is to provide an improved process for rendering cellulosic textile material both flame retardant and wrinkle resistant, with improved dimensional stability.

Additional objects and advantages of the present invention will be apparent to those skilled in the art by reference to the following summary of the characteristic features of the present invention and the subsequent description of the preferred embodiments.

In accordance with a primary aspect of the present invention, there is provided a process for rendering cellulosic fibercontaining material flame retardant, which process comprises contacting the material with cyanamide, at least one phosphonic acid represented by the structural formula:

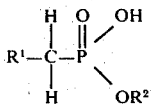

wherein $R^1$ represents a monovalent radical selected from the group consisting of hydrogen, halogen, hydroxy, lower alkyl and lower alkoxy, and $R^2$ represents a monovalent radical selected from the group consisting of hydrogen and lower alkyl; antimony oxide and a polymeric halogen-containing material to deposit on the cellulosic fiber-containing material a flame retarding amount of the phosphonic acid, cyanamide, antimony oxide and polymeric halogen-containing material.

In another aspect, there is provided a process for rendering cellulosic fiber-containing textile material flame retardant comprising in sequence the steps of: I. contacting the material with an aqueous solution of a flame retardant composition of cyanamide, at least one phosphonic acid selected from the group consisting of methyl phosphonic acid and methyl phosphonic acid monomethyl ester, antimony oxide and a vinyl chloride or vinylidene chloride-containing polymer; and II. heating the material to fix the flame retardant composition thereon.

DESCRIPTION OF THE PREFERRED EMBODIMENTS

As indicated above, cyanamide (HNCNH or $H_2NCN$), also known as carbodiimide, is used along with certain phosphonic acids, antimony oxide and a polymeric halogen-containing material to impart wash-resistant flame retardancy to the fibrous or fiber-containing meterial without detrimentally affecting other physical properties of the fibrous material.

The phosphonic acids which may be suitable can be represented by the general structural formula:

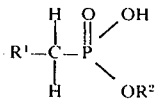

where $R^1$ represents a monovalent radical such as hydrogen, halogen, hydroxy, lower alkyl or lower alkoxy, and $R^2$ represents a monovalent radical such as hydrogen or lower alkyl. The alkyl radicals or portions of the radicals may contain, for example, from 1 to 4 carbon atoms.

Non-limiting examples of phosphonic acids having the above-described structural formula and which may be used according to the process of the present invention include methyl phosphonic to the process of the present invention inlcude methyl phosphonic acid, methyl phosphonic acid monemethyl ester, ethyl phosphonic acid, ethyl phosphonic acid monomethyl ester, chloromethyl phosphonic acid, chloromethyl phosphonic acid monomethyl ester, hydroxymethyl phosphonic acid, hydroxymethyl phosphoric acid monomethyl ester, methoxymethyl phosphonic acid, and methoxymethyl phosphonic acid monomethyl ester. Mixtures of two or more of the phosphonic acid may be used if desired.

The more preferred phosphonic acids are methyl phosphonic acid and methyl phosphonic acid monomethyl ester, and the most preferred phosphonic acid is methyl phosphonic acid insofar as it has been found to give or impart the most durable flame retardancy to the cellulosic materials.

Suitable polymeric halogen-containing material include the homopolymers and copolymers of vinyl chloride and vinylidene chloride. The commercially available polyvinyl chloride- and/or polyvinylidene chloridecontaining latexes (such as the "Geon" and "Polyco" flame retardant latexes available from the B. F. Goodrich Chemical Co. and Borden Co., respectively) are preferred as the halogen-containing flame retardant polymers.

The manner in which the phosphonic acids, cyanamide, antimony oxide and polymeric halogen-containing material are prepared or derived is per se well-known and does not form a part of the present invention.

The cellulosic and wool fiber-containing materials which may be treated according to the present invention are generally any of those which have been previously employed in conjunction with known flame retardants. The fiber-containing or textile material can have a wide variety of physical forms and can be fibers, filaments, yarns, threads, and particularly woven and non-woven cloth. The cellulosic fiber material can be cotton, flax, linen, hemp, or regenerated cellulose such as rayon (e.g., viscose rayon). Mercerized cotton may give particularly advantageous results. (Mercerized cotton is well-known per se; mercerization typically comprises passing cotton through a 25 to 30 percent solution of sodium hydroxide under tension, and then washing the cotton with water while under tension. Mercerization using liquid ammonia is also known.) These fiber-containing or textile materials can be mixtures of two or more different fibers, e.g., a mixture of cellulosic fibers with other fibrous materials such as nylon (e.g., nylon 6,6), polyester (e.g., polyethylene terephthalate), acrylics (e.g., polyacrylonitrile), polyolefins (e.g., polypropylene), polyvinyl chloride, polyvinylidene chloride, and polyvinyl alcohol fibers.

The preferred cellulosic textile materials are those containing 50 weight percent or more of cotton and especially pure, i.e., essentially 100 weight percent, cotton cloth.

According to a broad aspect of the present invention, fire or flame retardancy can be imparted to fibrous material by simply contacting or impregnating the material with the phosphonic acid, cyanamide, antimony oxide and polymeric halogen-containing material under widely varying conditions of temperature and pH. However, durable, i.e., wash resistant, flame retardancy is imparted only by fixing, i.e., reacting or polymerizing, the phosphonic acid, antimony oxide and polymeric halogen-containing material with or on the material. This fixing or "curing" is generally accomplished by heating the treated material at superambient temperatures and at low pH. Broadly, any temperature can be employed above which the phosphonic acid, cyanamide, antimony oxide and polymeric halogencontaining material are fixed or reacted on the material and below which undesirable thermal degradation of the material begins, and generally from 20° to 400°C., and preferably from 100° to 300°C. Optimum results are obtained at 120°to 180°C.

Durable flame retardance is imparted if, concurrently with the above-described heating, the pH of the reacting mixture on the material is low, i.e., typically less than 3.0 and preferably less than 2.5, e.g., about 2.2. While these pH's are believed to be critical to durability it is generally valid to assume that the pH of the reacting mixture on the material is the same as the pH of the mixture of phosphonic acid, cyanamide, antimony oxide and polymeric halogen-containing material and solvent when present, except as indicated below for the in situ generation of the reactants.

The fibrous material may be contacted with a simple mixture of the phosphonic acid, cyanamide, antimony oxide and polymeric halogencontaining material. A solvent is preferably present. The solvent can be employed in any amount up to infinite dilution as long as the final treated material has an add-on sufficient to impart flame retardancy, which add-on may be, for example, from 1 to 30 weight percent. Add-on is defined and used herein as the increase ("dry" basis) in weight of the fibrous material due to the addition of the flame retardant as a percentage of the weight of the untreated fibrous material. Examples of suitable solvents include lower alkanols such as methanol and ethanol, lower alkylene or alkyl ethers such as dioxane and ethyl ether, or, most preferably, water. Such solutions are termed pad baths.

The fibrous material can be contacted with the phosphonic acid, cyanamide, antimony oxide and polymeric halogen-containing material sequentially but is preferably contacted with all simultaneously.

Generally, the pad bath contains from about 2 to about 12, preferably from about 3 to about 9, percent by weight of the bath of the phosphonic acid, from about 2 to about 12, preferably from about 3 to about 9, percent by weight of the bath of cyanamide, from about 2 to about 12, preferably from about 3 to about 9, percent by weight of the bath of antimony oxide and from about 2 to about 12, preferably from about 3 to about 9, percent by weight of the bath of the polymeric halogen-containing material.

This mixture of phosphonic acid, cyanamide, antimony oxide and polymeric halogen-containing material can be employed at autogenous pH which is generally about 0.8 or at a slightly higher pH, e.g., about 1.0 to 1.5, except as indicated below for the in situ generation of the reactants where the pH of the pad bath may vary up to about 6.0. Naturally, in the latter case the pH of the pad bath may be quite different than the pH on the material at fixation.

A method by which the above-described phosphonic acids can be formed in situ is by the thermal degradation of the corresponding ammonium salt such as mono- or di-ammonium methyl phosphonic acid, or ammonium methyl phosphonic acid monomethyl ester. For example, ammonium hydroxide can be added to a pad bath containing the phosphonic acid (which would, of course, raise the pH, typically to about 3.0), antimony oxide and polymeric halogen-containing material. Thus, in the fixing step there is initially present, on the fibrous material, cyanamide and an ammonium salt of the phosphonic acid. Upon heating to fixation, the ammonium salt would decompose to ammonia and the corresponding phosphonic acid (resulting in a lowered pH). Usage of such ammonium salts and the inherent raising of the pH of the pad bath can be advantageous where lower pH (higher acidity) pad baths are not desired due to corrosion and personnel handling considerations.

In a preferred process for rendering fibrous materials such as cellulosic textile materials flame retardant according to the present invention, the material is first contacted with an aqueous solution comprising a mixture of phosphonic acid, cyanamide, antimony oxide and polymeric halogen-containing material at the desired pH. The excess solution is then removed from the material by any suitable means such as by passing the material between the nip of two rollers. The material is then dried to remove excess water. The drying can be accomplished at any temperature but is generally accomplished at superambient temperatures and preferably from 20° to 150°C. The material is then heated in order to fix the phosphonic acid, cyanamide, antimony oxide and polymeric halogen-containing material on the material and is conducted at the above-described fixation temperatures. The heating is conducted for at least several seconds and up to several hours, more typically from one to 15 minutes. In certain instances, the fixing may be generally complete in within 2 to 10 minutes. The drying and heating steps can be conducted simultaneously but are preferably conducted sequentially. The fixing of the phosphonic acid, antimony oxide and polymeric halogen-containing material with the cyanamide on cellulosic material is presently thought to occur in the form of a reaction product which then reacts with the hydroxyl groups of the cellulosic material.

The treated fibrous material preferably has sufficient add-on such that it exhibits the desired degree of flame retardancy. Such materials generally have add-ons of 1 to 30, and preferably 10 to 20, percent.

It is only critical to the present invention that the above-described phosphonic acids, cyanamide, antimony oxide and polymeric halogencontaining material be present on the fibrous material. Therefore, according to another embodiment of the present invention many of these compounds can be formed in situ. A preferred method by which the above-described phosphonic acids can be formed in situ is by the above-described thermal degradation of the corresponding ammonium salt such as ammonium methyl phosphonic acid monomethyl ester, or mono- or di-ammonium methyl phosphonic acid. Another method which involves thermally decomposable esters which upon heating yield the above-described phosphonic acids can be employed. Examples of such esters include among others methyl phosphonic acid mono-t-butyl ester and methyl phosphonic acid monomethyl ester monot-butyl ester. These compounds thermally decompose to give, respectively, methyl phosphonic acid and methyl phosphonic acid monomethyl ester. A third method may be by the use of metal salts of the phosphonic acids together with means for creating the low pH's necessary to effect fixation. For example, the pH of the pad bath may be increased with sodium hydroxide, followed by the addition of ammonium chloride. Thus, in the fixing step there would be present on the cellulosic material, cyanamide, a sodium salt of the above-described phosphonic acids, ammonium chloride, antimony oxide and polymeric halogen-containing material. Upon heating, the ammonium chloride would decompose to ammonia and hydrochloric acid converting the sodium salt to the free acid to accomplish fixation. Naturally, in these cases the pH of the pad bath may be quite different than the pH on the material.

The solution of phosphonic acid, cyanamide, antimony oxide and polymeric halogen-containing material into which the cellulosic material is dipped may also contain, if desired, conventional dispersants, softeners, lubricants, stiffeners, brighteners, water-repellants, soil release agents, and dyes.

The invention is additionally illustrated in connection with the following Examples which are to be considered as illustrative of the present invention. It should be understood, however, that the invention is not limited to the specific details of the Examples.

EXAMPLE I

To compare three different systems, pad baths were made as given in Table I. For baths with ammonium hydroxide in them, enough was added to bring the final pH to about 2.1 – 2.2. The balance of each pad bath was water.

Each bath was padded onto a 3.3-ounce cotton flannelette at a 100 percent wet pick-up (W.P.U.). The fabric was dried five minutes at 220°F., cured 3 minutes at 330°F., washed in 0.1 percent sodium tripolyphosphate, rinsed and dried. All fabrics were top-softened with 3 percent Polylube FFN (a polyethylene emulsion).

The physical properties of each finished fabric are given in Table II. Tensile, tear, and abrasion are given in terms of percent retention compared to untreated fabric. Shrinkage is given after processing and after five launderings and is based on the untreated, unlaundered fabric.

Treated fabrics were laundered according to FF 3-71, the Children's Sleepwear Standard, in water of 150 ppm hardness. Results at various laundering intervals are given in Table III. Fabrics treated as in Run B (vinyl chloride copolymer latex and $Sb_2O_3$ alone) failed the standard. In addition, fabrics treated with this finish showed long afterglow times of over 60 seconds. The average afterglow times for Runs A and C were 0 and 2 seconds, respectively.

The initial hand of the fabrics treated as in Run B were relatively stiff and heavy, and certainly not suitable for wearing apparel. Fabrics treated as in Runs A and C both showed a soft, pleasant initial hand. However, at the end of the fifty laundering cycles reported above, the fabric treated as in Run A (methyl phosphonic acid and cyanamide alone) showed chalky, rough deposits on the fabric. In addition, most of the nap had been removed from the flannelette. Fabrics treated as in Run C (methyl phosphonic acid, cyanamide, $Sb_2O_3$ and vinyl chloride copolymer latex) surprisingly still had a soft pleasant hand after fifty launderings. After fifty launderings, durable press properties were still evident in this fabric, which was not the case with fabrics treated as in Run A.

Compared to either of the systems from which it derives, the process of the present invention yields unusual properties relating to durability of flame retardancy, short afterglow, good initial hand, good hand after laundering, good strength retention, low shrinkage and good appearance after launderings.

Table I

| | Run A | Run B | Run C |
|---|---|---|---|
| % Methyl phosphonic acid | 15 | — | 6 |
| % Cyanamide[1] | 15 | — | 6 |
| % Vinyl Chloride Copolymer[2] | — | 14.6 | 7.3 |
| % Antimony Oxide | — | 12 | 6 |
| % Tamol SN[3] | — | 0.6 | 0.3 |
| % Dowfax 2Al[4] | — | 0.45 | 0.45 |
| % Triton X-100[5] | 0.1 | — | — |
| % $NH_4OH$ | X[6] | — | X[6] |

[1]Added as 50 percent aqueous solution ("Pyroset CP" available from American Cyanamid Co.).
[2]Added as 56 percent solids vinyl chloride copolymer latex ("Polyco 2611" available from the Borden Chemical Co.).
[3]A dispersing agent for the antimony oxide which is a sodium salt of a condensed naphthalene sulfonic acid.
[4]A latex stabilizer which is a sodium dodecyl diphenyl ether disulfonate.
[5]A wetting agent which is an alkylphenyl polyether alcohol.
[6]Amount sufficient to make the pH of the pad bath 2.1 – 2.2.

Table II

| Fabric | % Retention: Grab Tensile Warp | Grab Tensile Fill | Elmendorf Tear Warp | Elmendorf Tear Fill | Stoll Flex Abrasion* Back | Stoll Flex Abrasion* Face |
|---|---|---|---|---|---|---|
| Run A | 58 | 51 | 38 | 40 | 21 | 23 |
| Run B | 115 | 92 | 94 | 93 | 197 | 421 |
| Run C | 97 | 70 | 63 | 59 | 43 | 60 |
| Untreated | — | — | — | — | — | — |

| Fabric | % Shrinkage: During Processing Warp | During Processing Fill | After Five Launderings Warp | After Five Launderings Fill |
|---|---|---|---|---|
| Run A | 8.8 | 7.1 | 13.1 | 8.3 |
| Run B | 0 | 7.1 | 2.3 | 7.1 |
| Run C | 0 | 4.8 | 2.3 | 7.1 |
| Untreated | — | — | 4.8 | 9.5 |

*Performed in warp direction only.

Table III

| | Char Lengths According to FF 3-71 (in inches): Initially | After 25 Washes | After 50 Washes |
|---|---|---|---|
| Run A | 1.3 | 2.5 | 3.5 |
| Run B | 2.9 | 6.0 | 7.9 |
| Run C | 1.9 | 2.8 | 3.1 |

EXAMPLE II

The general procedure of Example I was repeated on 3.3-ounce cotton flannelette (Runs D and E) and 8-ounce cotton twill (Run F). The composition of the pad bath used is shown in Table IV. The fabrics in Runs D and E were each padded at a 100 percent W.P.U., dried for 5 minutes at 250°F., cured 5 minutes at 330°F., and washed in 0.1 percent sodium tripolyphosphate. The fabric in Run F was padded at a 75 percent W.P.U., dried 5 minutes at 250°F., cured 7 minutes at 330°F., and washed in 0.1 percent sodium tripolyphosphate.

The results of flame retardance (FF 3-71) after 25 and 50 launderings are shown in Table V.

Table IV

| | Run D | Run E | Run F |
|---|---|---|---|
| % Methyl phosphonic acid | 5 | 5 | — |
| % Chloromethyl phoshonic acid | — | — | 8.5 |
| % Cyanamide[7] | 5 | 5 | 10 |
| % Vinyl Chloride Copolymer[8] | — | 7.3 | — |
| % Vinylidene Chloride Copolymer[9] | 5.5 | — | — |
| % Vinylidene Chloride Copolymer | — | — | 10.5 |
| % Antimony Oxide | 7 | 6 | 5 |
| % Tamol SN[10] | 0.6 | 0.5 | 0.5 |
| % Dowfax 2Al[11] | 0.45 | 0.45 | 0.5 |
| % NaOH | X[12] | X[12] | X[12] |

[7]Added as 50 percent aqueous solution ("Pyroset CP" available from American Cyanamid Co.).
[8]Added as 56 percent solids vinyl chloride copolymer latex ("Polyco 2611" available from the Borden Chemical Co.).
[9]Added as 50 percent solids vinylidene chloride copolymer latex ("Geon 660X1" or "Geon 660X2" available from the B.F. Goodrich Co.).
[10]A dispersing agent for the antimony oxide which is a sodium salt of a condensed naphthalene sulfonic acid.
[11]A latex stabilizer which is a sodium dodecyl diphenyl ether disulfonate.
[12]Amount sufficient to make the pH of the pad bath 2.1 – 2.2.

Table V

| | Char Lengths According to FF 3-71 (in inches): Initially | After 25 Washes | After 50 Washes |
|---|---|---|---|
| Run D | 2.2 | 2.0 | 2.8 |
| Run E | 2.5 | 2.3 | 2.2 |
| Run F | 1.2 | 2.2 | 3.9 |

The treated fabrics had a soft hand, low (less than 3 percent) shrinkage and good flame retardant properties.

COMPARATIVE EXAMPLE

Application was made to a four-ounce cotton flannelette with a pad bath consisting of 15 percent urea, 6 percent diammonium phosphate, 4.5 percent phosphoric acid, 15 percent Polyco 2611, 7 percent antimony oxide, 0.45 percent Dowfax 2A1, and 0.6 percent Tamol SN. W.P.U. was 100 percent. This level of application consists of higher levels of phosphorus, antimony, and chlorine than that applied in Run C of Example I. The padded fabric was dried 5 minutes at 250°F., cured 3 minutes at 350°F. and washed in 0.1 percent sodium tripolyphosphate at 60°C. When tested according to FF 3-71, the fabric showed an average initial char length of 1.5 inches. After ten launderings in water of 150 ppm hardness, the same fabric burned the entire length in the FF 3-71 flame test. Unlike the treatment of the present invention, this finish is not durable to even ten launderings in hard water.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is clamed is:

1. A process for rendering cellulosic fiber-containing material flame retardant, which process comprises contacting the material with cyanamide, at least one phosphonic acid represented by the structural formula:

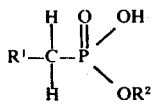

wherein $R^1$ represents a monovalent radical selected from the group consisting of hydrogen, halogen, hydroxy, lower alkyl and lower alkoxy; and wherein $R^2$ represents a monovalent radical selected from the group consisting of hydrogen and lower alkyl; antimony oxide and a flame-retardant polymeric halogencontaining material selected from the group consisting of halogenated vinyl and vinylidene polymers and copolymers to deposit on the cellulosic fiber-containing material a flame retarding amount of the phosphonic acid, cyanamide, antimony oxide and polymeric halogen-containing material.

2. A process according to claim 1 wherein the phosphonic acid is methyl phosphonic acid and the polymeric halogen-containing material is taken from the group consisting of polymers and copolymers of vinyl chloride and vinylidene chloride and chlorinated paraffins.

3. A process according to claim 1 wherein said material is contacted with a single pad bath containing from about 2 to about 12 percent by weight of the bath of cyanamide, from about 2 to about 12 percent by weight of the bath of the phosphonic acid, from about 2 to about 12 percent by weight of the bath of antimony oxide and from about 2 to about 12 percent by weight of the bath of the polymeric halogen-containing material.

4. A process according to claim 1 wherein said material is contacted with a single pad bath containing from about 3 to about 9 percent by weight of the bath of cyanamide, from about 3 to about 9 percent by weight of the bath of the phosphonic acid, from about 3 to about 9 percent by weight of the bath of antimony oxide and from about 3 to about 9 percent by weight of the bath of the polymeric halogen-containing material.

5. A process for rendering cellulosic fiber-containing textile material flame retardant comprising in sequence the steps of:

I. contacting the material with an aqueous solution or flame retardant composition of cyanamide, at least one phosphonic acid selected from the group consisting of methyl phosphonic acid and methyl phosphonic acid monomethyl ester, antimony oxide and a vinyl chloride or vinylidene chloride-containing polymer; and II. heating the material to fix the flame retardant composition thereon.

6. A process according to claim 5 wherein said material is contacted with a single pad bath containing from about 2 to about 12 percent by weight of the bath of cyanamide, from about 2 to about 12 percent by weight of the bath of the phosphonic acid, from about 2 to about 12 percent by weight of the bath of antimony oxide and from about 2 to about 12 percent by weight of the bath of the vinyl chloride or vinylidene chloride-containing polymer.

7. A process according to claim 6 wherein said material is contacted with a single pad bath containing from about 3 to about 9 percent by weight of the bath of cyanamide, from about 3 to about 9 percent by weight of the bath of the phosphonic acid, from about 3 to about 9 percent by weight of the bath of antimony oxide and from about 3 to about 9 percent by weight of the bath of the vinyl chloride or vinylidene chloride-containing polymer.

8. A process according to claim 5 wherein said aqueous solution has a pH of less than about 3.0.

* * * * *